United States Patent [19]

Dean et al.

[11] Patent Number: 4,768,681

[45] Date of Patent: Sep. 6, 1988

[54] FLUID ACTION TOY WORN BY USER

[75] Inventors: Bryan L. Dean, Torrington; Victor G. Reiling, Litchfield, both of Conn.

[73] Assignee: Multi Toys Corp., Cresskill, N.J.

[21] Appl. No.: 65,006

[22] Filed: Jun. 22, 1987

[51] Int. Cl.[4] ..... A63H 3/18

[52] U.S. Cl. ..... 222/79; 222/175; 446/26; 446/473; 446/475; 2/160

[58] Field of Search ..... 222/79, 78, 175, 333; 239/152, 153, 154; 446/26, 473, 475, 483; 2/160; 42/54; 224/148, 267; 439/37

[56] References Cited

U.S. PATENT DOCUMENTS

| | | | |
|---|---|---|---|
| 1,885,180 | 11/1932 | Cameron | 239/154 X |
| 3,107,069 | 10/1963 | Draim | 239/154 X |
| 3,949,517 | 4/1976 | Reiner et al. | 439/37 X |
| 3,953,935 | 5/1976 | Reiner et al. | 446/26 |
| 4,022,350 | 5/1977 | Amron | 222/79 X |
| 4,037,790 | 7/1977 | Reiser et al. | 222/175 X |
| 4,239,129 | 12/1980 | Esposito | 222/79 |
| 4,706,848 | 11/1987 | D'Andrade | 222/79 |

FOREIGN PATENT DOCUMENTS

| | | | |
|---|---|---|---|
| 39534 | 9/1973 | Australia | 222/195 |

*Primary Examiner*—Joseph J. Rolla
*Assistant Examiner*—Nils E. Pedersen
*Attorney, Agent, or Firm*—Kirschstein, Kirschstein, Ottinger & Israel

[57] ABSTRACT

A water action toy is worn on a child's hand by means of a glove secured to and underneath a housing in which a water reservoir, a water pump, an electrical motor and a battery pack are housed. A pair of actuators are mounted on a thumb sheath and a forefinger sheath of the glove. When the actuators are brought together by finger manipulation, the motor drives the pump to eject water in a series of spurts from the toy.

9 Claims, 3 Drawing Sheets

FLUID ACTION TOY WORN BY USER

BACKGROUND OF THE INVENTION

1. Field of the Invention

This invention generally relates to a fluid action toy and, more particularly, to a gloved toy worn on a user's hand, and operative for ejecting water under pressure by selective actuation of a battery-powered pump.

2. Description of Related Art

Water guns are popular toys which squirt water under pressure when a user, typically a child, manually depresses a trigger, usually situated behind a trigger guard on a handle of the gun. In recent years, such water guns have included battery-powered pumps so that, upon depression of the trigger, the water can be pumped under pressure over great distances away from the gun. Although generally satisfactory and enjoyable in use, the conventional water guns are subject to breakage when a child drops them, particularly during hectic play.

SUMMARY OF THE INVENTION

1. Objects of the Invention

It is a general object of this invention to overcome the drawbacks associated with conventional water guns.

It is another object of this invention to provide a novel fluid-ejecting toy which cannot, or at least not very readily, fall from a child's hand.

It is a further object of this invention to provide a fluid action toy which is worn snugly on a user's hand.

Still another object of this invention is to provide a durable fluid action toy which is inexpensive in construction and fun to use.

2. Features of the Invention

In keeping with these objects, and others which will become apparent hereinafter, one feature of this invention resides, briefly stated, in a fluid action toy which comprises a housing having a reservoir fillable with a fluid, particularly water, as well as a fluid discharge port. An electrically driven pumping means is located in the housing, and is operative for conveying the water under pressure from the reservoir through and past the discharge port, typically several feet in front of the toy. An electrical power source, e.g. a battery pack, is also provided in the housing and supplies electrical power to the pumping means.

A glove is secured to and underneath the housing in an intended position of use wherein the glove is worn on a user's hand. The glove has, in a preferred embodiment, five finger sheaths for receiving all of the fingers of the user's hand. At least one of the finger sheaths is movable relative to an adjacent sheath by finger manipulation. The glove is preferably made of a flexible material to permit one or more, if not all, of the sheaths to be movable relative to one another.

Actuator means is provided on the glove. The actuator means is electrically connected between the power source and the pumping means, and is operative for selectively actuating the pumping means to eject the fluid away from the discharge port. A pair of actuators, one on each of two adjacent finger sheaths, e.g. the forefinger sheath and the thumb sheath, are normally positioned away from each other to prevent operation of the pumping means, and are positioned in contact with each other to permit operation of the pumping means in response to relative movement of the movable sheath relative to its adjacent sheath.

Since the fluid action toy is worn on the user's hand due to the securement of the glove to and underneath the housing, the toy cannot fall from the user's hand during hectic play. The glove is preferably snugly worn on the user's hand to insure that the toy will not fall therefrom. During play, the user need only point his arm on which the toy is supported in the general direction of a target. Thereupon, by merely moving the actuator on the thumb sheath into contact with the actuator on the forefinger sheath, an electrical connection is made between the power source and the pumping means, thereby commencing the conveying of pressurized fluid from the toy to the target. To stop such fluid ejection, the user need only move the contact on the thumb sheath away from, and out of contact with, the contact on the forefinger sheath.

For increased user enjoyment, a bulb may be positioned in the vicinity of the fluid discharge port. In operation, whenever fluid is being ejected from the toy, the bulb is energized.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENTS

Figure 1:
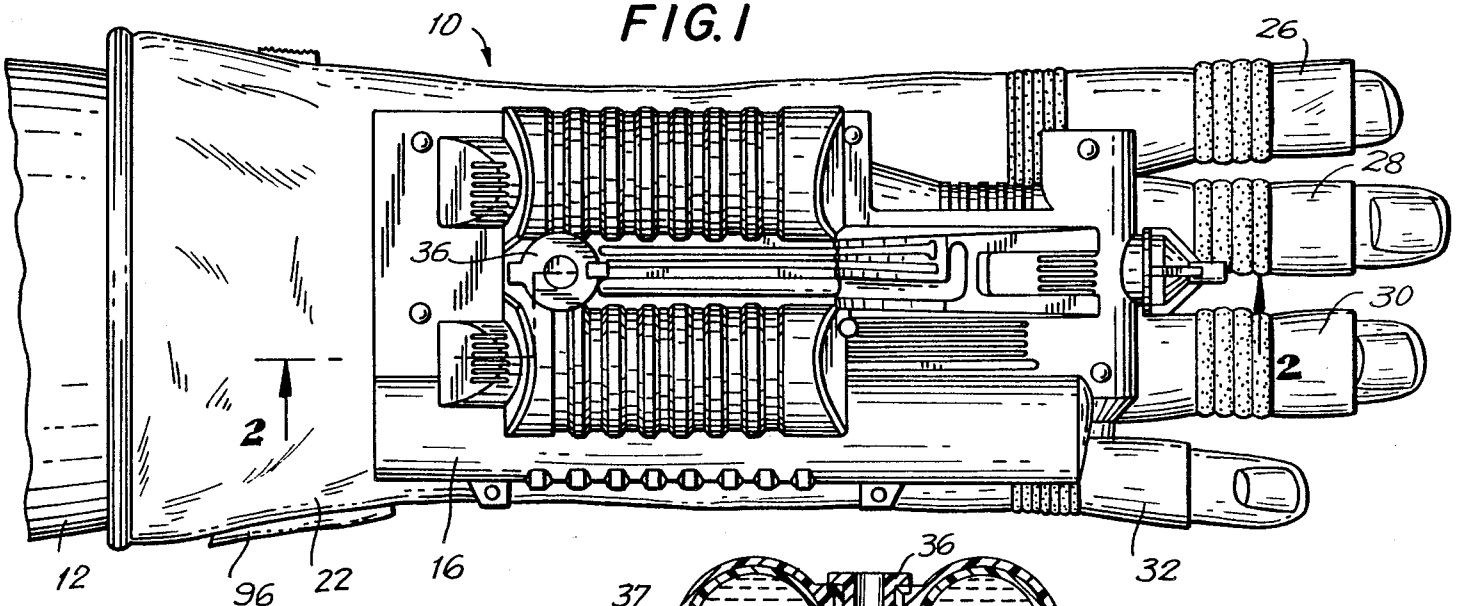
FIG. 1 is a top plan view of a fluid action toy in accordance with this invention, in the intended position of use on a user's hand.
Figure 4:
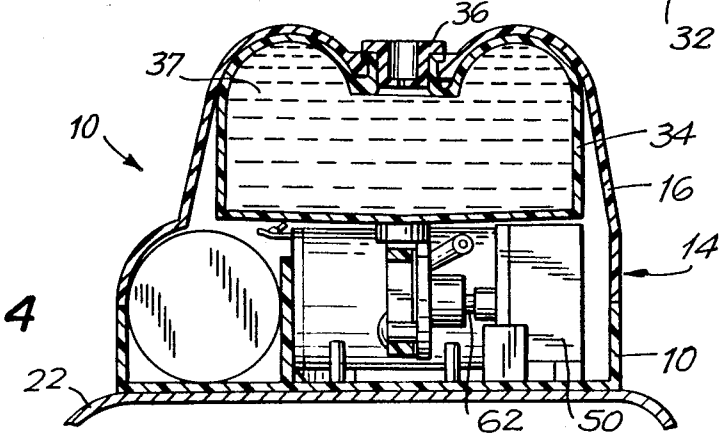
FIG. 4 is a sectional view taken on line 4—4 of FIG. 2.

Referring now to the drawings, reference numeral 10 generally identifies a fluid action toy which, in the intended position of use, is worn on, and supported by, a hand 12 of a user, particularly a child. The toy 10 includes a two-part housing 14 having an upper part 16 and a lower part 18 which are joined together along a common separating line 20. The housing is made of an injection-molded synthetic plastic material, preferably of high-impact resistance.

The toy 10 also includes a glove 22 secured to and underneath the lower part 18. The securement may be by an adhesive layer between a base wall of the lower part 18 and an upper part of the glove 22, or, in a preferred embodiment, rivets or analogous fasteners may be connected between the glove and the lower housing part 18.

The glove 22 is fabricated of a flexible material, e.g. a fabric, leather, vinyl or thin-layered synthetic plastic material, and is provided with five finger sheaths, namely, a thumb sheath 24, a forefinger sheath 26, a middle finger sheath 28, a ring finger sheath 30 and a pinky sheath 32. Each finger sheath receives a respective finger of the child's hand 12. As shown, each sheath is cut off in the nail region of each finger so that each finger actually extends through and past the sheath, although that is not altogether necessary. The cut-off sheaths permit different child hand sizes to be readily accommodated.

A reservoir or tank 34 is mounted within the upper part 16 of the housing 14, and has an upper inlet which is selectively opened or closed by a plug or stopper 36. When the plug 36 is removed from the inlet, fluid, e.g. water 37, can be introduced into the reservoir 34 from any available water supply. When the plug 36 is inserted tightly into the inlet, the water 37 is prevented from escaping the inlet past the plug 36 which serves as a seal.

Figure 2:
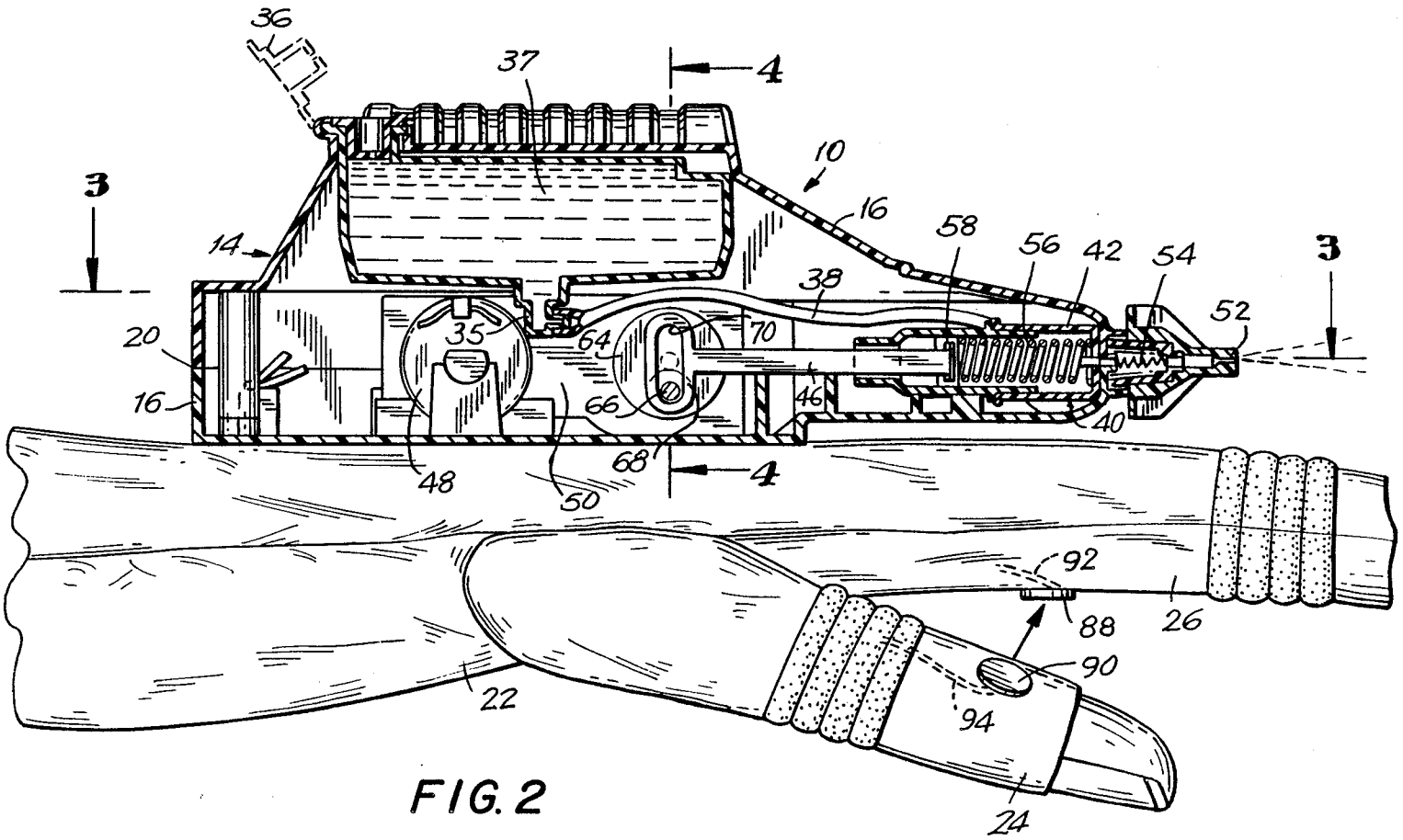
FIG. 2 is a sectional view taken on line 2—2 of FIG. 1.

As best shown in FIG. 2, the water 37 in reservoir 34 descends by gravity into a funnel-shaped lower fitting 35 to which one end of a flexible feed tube 38 is mounted. The other end of the feed tube 38 is connected to a water pump 40 and, more particularly, to a cylinder 42 by way of an inlet valve assembly 44 (see FIG. 3). The inlet valve assembly 44 is a one-way valve which is open and permits water to flow from the feed tube 38 into the cylinder 42 when an under-pressure exists in the latter, and which is closed and prevents water within the cylinder 42 from entering the feed tube 38 when an over-pressure exists in the cylinder. The over- or under-pressure condition within the cylinder 42 is alternatingly and repetitively generated by a piston 46 which is reciprocatingly driven in the direction of double-headed arrow A in FIG. 3 by an electrical motor 48 in cooperation with a force-transmitting transmission 50. When the piston 46 is moved to the left in FIG. 2, a suction or under-pressure condition is produced witnin cylinder 42 and, hence, water is drawn or pulled into the cylinder through the opened inlet valve assembly 44. When the piston 46 is moved to the right in FIG. 2, an over-pressure condition is produced within the cylinder 42. This over-pressure closes the inlet valve assembly 44 so that water within the cylinder 42 cannot flow back up in countercurrent direction into the feed tube 38. Instead, as explained below, the water is discharged from a fluid discharge port 52 which is in selective fluid communication with the cylinder 42 through an outlet valve assembly 54. The outlet valve assembly 54 is also a one-way valve, except that it works oppositely to the inlet valve assembly 44. When the outlet valve assembly 54 is opened, the inlet valve assembly 44 is closed, and vice versa. Thus, an under-pressure in cylinder 42 closes outlet valve assembly 54 and opens inlet valve assembly 44, whereas an over-pressure in the cylinder 42 opens outlet valve assembly 54 and closes inlet valve assembly 44.

A coil spring 56, best shown in FIG. 2, is situated along and in the cylinder 42, and constantly bears against a head 58 of the piston 46. The spring 56 works to always push the piston 46 to the left in FIG. 2 so that at least a small under-pressure condition will always prevail in cylinder 42 to draw at least a limited amount of water therein during operation.

The electrical motor 48 is of conventional construction, and has an output shaft 60 which, during operation, rotates at a fairly high rate of speed. The shaft 60 extends into, and is geared down by, a gear train within transmission 50. The gear train includes a series of meshing gears having different numbers of teeth which convert the high, rapid rate of rotation of the output shaft 60 of the motor 48 to a much slower rate of rotation for a drive shaft 62. A drive wheel 64 is mounted for joint rotation with the drive shaft 62. A drive pin 66 is eccentrically mounted for joint rotation with the drive wheel, and is offset radially relative to the drive axis along which the drive shaft 62 is rotatable. A tail end 68 of the piston 46 is formed with an elongated slot 70 which extends generally perpendicularly of the direction of reciprocation of the piston 46.

In operation, as the output shaft 60 of the motor rapidly rotates, the drive shaft 62, the drive sheel 64 and the drive pin 66 rotate more slowly. The drive pin 66 moves lengthwise along the slot and, in doing so, pulls and pushes the piston repeatedly and alternatingly in the direction of the double-headed arrow A. Each time the piston is moved to the right in FIG. 2, the outlet valve assembly 54 is opened, and water within the cylinder 42 is ejected under pressure through the discharge port 52 over a great distance from the toy toward a target in a series of intermittent spurts. Each time piston 46 is moved to the left in FIG. 2, more water is fed from the reservoir 34 into the cylinder 42. The speed of reciprocation of the piston 46 determines the rate at which the water is delivered into the cylinder 42, and the rate at which the water within the cylinder 42 is squirted from the toy, as well as the duration of th water spurts.

Figure 3:
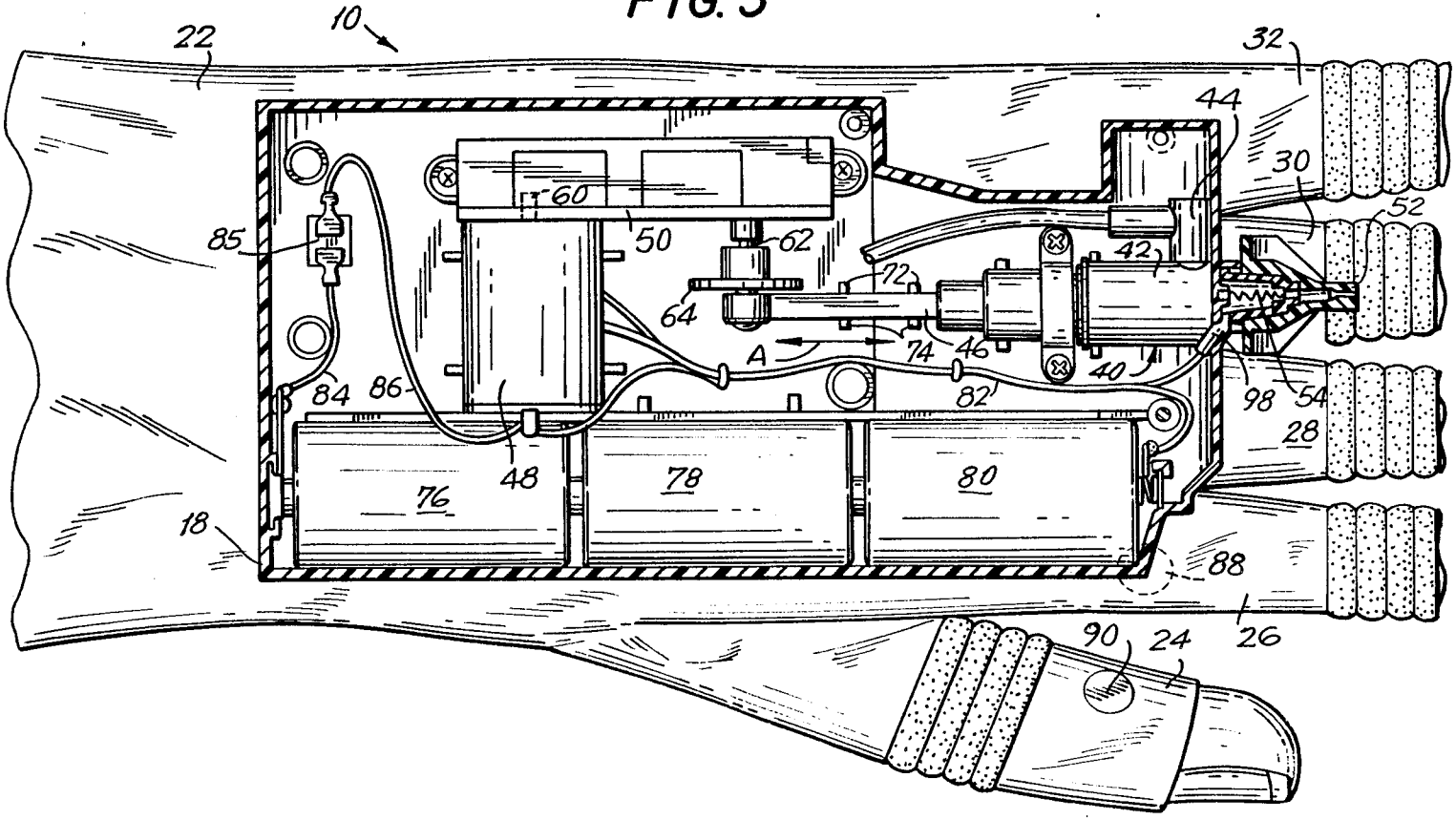
FIG. 3 is a sectional view taken on line 3—3 of FIG. 2.

As shown in FIG. 3, a first pair of guides 72 are located at one side of the piston 46. A second pair of guides 74 ae located at the opposite side of the piston 46. The first and second pairs of guides bound therebetween a channel along which the piston 46 is reliably guided along a straight line during its forward and backward strokes into and out of the pump cylinder 42.

In order to energize the electrical motor 48, an electrical power source, e.g. a pack of batteries 76, 78, 80, are mounted in a separate compartment within the housing. A first electrical wire 82 extends from one end of the battery pack to the motor. A second electrical wire 84 extends from the other end of the battery pack to one conductive socket of an electrical connector assembly 85. A third electrical wire 86 extends from another conductive socket of the connector assembly 85 to the motor 48. To complete the electrical interconnection between the motor 48 and the battery pack, actuator means are connected between the aforementioned conductive sockets of the connector 85. More particularly, the actuator means includes a pair of electrically conductive actuators 88,90 provided remotely from the conductive sockets, but electrically connected thereto by electrical wires 92, 94 (see FIG. 2). The actuators 88, 90 are formed as button-like contacts or discs which function as an electrical switch. When the discs 88, 90 are positioned apart from each other, the switch is open, and no electrical current flows from the battery pack to the motor. When the discs 88, 90 are placed into physical contact with each other, the switch is closed, and electrical current flows from the battery pack to the motor. In order to effect the relative movement between the discs 88, 90, it is necessary for the child to manipulate his or her thumb and/or forefinger in order to bring the thumb sheath 24 and the forefinger sheath 26 closer together or further apart, as desired. As previously mentioned, the glove and the sheaths are made of a flexible material so that when the childs fingers are moved, the sheaths covering those fingers participate in such movement and, of course, the discs 88, 90 participate in the movement of the sheaths.

In summary, the toy is used as follows:

The child inserts his or her hand into the glove 22 so that the child's fingers extend into, and preferably through, the finger sheaths. A wrist strap 96 of adjustable length may conveniently be closed to secure the toy in position. It is, of course, assumed that, prior to mounting the toy on the child's hand, the plug 36 has been removed from the inlet of the reservoir 36, and water has been introduced therein.

Thereupon, the child merely points his hand in the general direction of a target to be squirted, e.g. a playmate. Next, by merely manipulating his thumb and forefinger so that the actuator discs 88, 90 are positioned in physical contact with each other, the electrical motor 48 is energized and, in turn, the piston 46 is reciprocated back and forth in pump cylinder 42, thereby alternatingly and repetitively drawing water into the pump cylinder 42 from the reservoir 34, and ejecting the water within the cylinder 42 under pressure from the discharge port 52. As long as the discs 88, 90 are in contact with each other, the squirting of water will continue as a series of intermittent pulsating spurts. Although, in a preferred embodiment of this invention, the water is ejected in a series of spurts, the invention is not intended to be so limited, since it is also comprehended within the spirit and scope of this invention that the water be ejected continuously, rather than intermittently, whenever the discs 88, 90 are positioned in mutual contact. Of course, to cease squirting, the child need only manipulate his fingers so that the discs 88, 90 are positioned out of contact with each other, whereupon power is removed from the motor 48 and, concomitantly, the pump 40 ceases to function.

Another feature of this invention resides in the placement of a low-voltage bulb 98 adjacent the discharge port 52. The bulb 98 is connected by electrical wiring across the motor. When the motor is energized, electrical current is also fed to the bulb 98, thereby lighting the same. When the motor is not energized, the bulb is extinguished. Of course, the lighting and extinguishing of the bulb 98 can be seen exteriorly of the toy. This lighting and extinguishing cf the bulb 98,coupled with the intermittent ejection cf water, makes for a toy with a high entertainment value.

It will be understood that each of the elements described above, or two or more together, also may find a useful application in other types of constructions differing from the types described above.

While the invention has been illustrated and described as embodied in a fluid action toy worn by user, it is not intended to be limited to the details shown, since various modifications and structural changes nay be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A fluid action toy, comprising:

(a) a housing having a reservoir fillable with a fluid, and a fluid discharge port;

(b) an electrically-driven pumping means in the housing for conveying the fluid under pressure from the reservoir through and past the discharge port;

(c) an electrical power source in the housing for supplying power to the pumping means;

(d) a glove secured to and underneath the housing in an intended position of use wherein the glove is worn on a user's hand, said glove having two adjacent finger sheaths for receiving two fingers of the user's hand, at least one sheath being movable relative to the other by finger manipulation; and (e) actuator means on the glove and electrically connected between the power source and the pumping means, and operative for selectively actuating the pumping means to eject the fluid away from the discharge port, said actuator means including a pair of actuators, one on each finger sheath, said actuators being normally positioned away from each other to prevent operation of the pumping means, and being positioned in contact with each other to permit operation of the pumping means in response to relative movement of said one sheath relative to said other sheath.

2. The fluid action toy as recited in claim 1, wherein the actuators are electrically-conductive discs secured to each sheath and having exposed outer surfaces at the exterior of each sheath.

3. The fluid action toy as recited in claim 2, wherein the pumping means includes a pump having a cylinder in which a piston is reciprocatingly received, an electrical motor having a rotating output shaft, and a force-transmitting transmission between the output shaft and the piston for reciprocating the piston in response to output shaft rotation.

4. The fluid action toy as recited in claim 3, wherein the transmission includes a step-down gearing having a drive shaft which rotates about a drive axis at a slower rate than the output shaft, a drive wheel mounted on the drive shaft and having an eccentric drive pin mounted on the drive wheel for rotation about the drive axis, and an elongated drive slot formed in an end region of the piston and extending in a direction generally normally of the direction in which the piston is reciprocated, said drive pin being received in the drive slot.

5. The fluid action toy as recited in claim 4, wherein the pump has inlet valve means in selective fluid communication with the reservoir, and outlet valve means in selective fluid communication with the discharge port, one valve means being opened while the other valve means is closed during operation of the pumping means.

6. The fluid action toy as recited in claim 1, and further comprising means at the fluid discharge port for emitting light during operation of the pumping means.

7. The fluid action toy as recited in claim 1, wherein the two adjacent finger sheaths are the forefinger sheath and the thumb sheath, both sheaths being movable toward and away from each other.

8. The fluid action toy as recited in claim 1, wherein the power source is a self-contained battery pack in the housing.

9. The fluid action toy as recited in claim 1, wherein the reservoir has a selectively openable and closable inlet at the exterior of the housing.

* * * * *